US009475316B2

(12) United States Patent
Hiramatsu et al.

(10) Patent No.: US 9,475,316 B2
(45) Date of Patent: Oct. 25, 2016

(54) PRINTING APPARATUS WITH NOISE SUPRESSION

(71) Applicant: SEIKO EPSON CORPORATION, Tokyo (JP)

(72) Inventors: Kazunori Hiramatsu, Okaya (JP); Hiroaki Sakai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/659,011

(22) Filed: Mar. 16, 2015

(65) Prior Publication Data

US 2015/0266323 A1 Sep. 24, 2015

(30) Foreign Application Priority Data

Mar. 19, 2014 (JP) ..... 2014-056252

(51) Int. Cl.
*B41J 19/20* (2006.01)

(52) U.S. Cl.
CPC ..... *B41J 19/202* (2013.01)

(58) Field of Classification Search
None
See application file for complete search history.

(56) References Cited

U.S. PATENT DOCUMENTS

2002/0145639 A1* 10/2002 Masuda ..... B41J 2/04541 347/14
2006/0038524 A1* 2/2006 Okamoto ..... H02P 5/74 318/625
2006/0244401 A1* 11/2006 Chida ..... H02P 29/0038 318/400.23
2010/0171453 A1* 7/2010 Yasohara ..... H02P 23/06 318/400.21
2011/0176827 A1* 7/2011 Tobita ..... G03G 15/80 399/88
2011/0273498 A1* 11/2011 Kasai ..... B41J 2/04541 347/10
2012/0206753 A1* 8/2012 Harasawa ..... B41J 29/00 358/1.13
2014/0151457 A1* 6/2014 Wilkerson ..... H01L 41/042 239/4

FOREIGN PATENT DOCUMENTS

JP 2009-291995 12/2009
JP 2009291995 A * 12/2009

* cited by examiner

*Primary Examiner* — Bradley Thies
(74) *Attorney, Agent, or Firm* — Workman Nydegger

(57) ABSTRACT

A printer includes a base on which a medium is mounted, a liquid ejecting unit which performs printing on the medium mounted on the base, an AC servo motor which is installed in the base, and is driven when the base and the liquid ejecting unit are relatively moved, an inverter which is installed in the base and drives the AC servo motor based on power supplied from an external AC power supply, and a power supply portion which is installed in the base and supplies the power supplied from the AC power to the liquid ejecting unit supply through the power transmission cable. The power supply portion includes an AC/DC converter that converts the AC power to DC power and outputs the converted DC power to the power transmission cable.

9 Claims, 4 Drawing Sheets

PRINTING APPARATUS WITH NOISE SUPRESSION

The present application claims priority to Japanese Patent Application No. 2014-056252 filed on Mar. 19, 2014, which is hereby incorporated by reference in its entirety.

BACKGROUND

1. Technical Field

Embodiments of the present invention relate to a printing apparatus.

2. Related Art

In the related art, there is a printer that performs printing on a medium by relatively moving a printing unit with respect to a mounting stand on which a medium such as paper is mounted. The printing unit has a print head that performs printing by ejecting ink onto the medium. An example of such a printer includes a flatbed type printer (for example, refer to JP-A-2009-291995).

A driving motor, which is driven when the printing unit is relatively moved with respect to the mounting stand, and a motor driving portion for driving the driving motor are installed in the mounting stand of the printer. In general, an inverter is provided in the motor driving unit. The inverter converts AC power supplied from an external commercial power supply to DC power. Then, the DC power is re-converted to AC power. The re-converted power is then supplied to the driving motor. The AC power re-converted by the inverter is also supplied to the printing unit through a power transmission cable which is wired in a flexible guide linking the mounting stand with the printing unit.

Meanwhile, various circuits such as a control circuit of the print head and a control circuit of the driving motor, an AC/DC converter that converts the AC power which is supplied through the power transmission cable to DC power, and a DC/DC converter that steps down a voltage of the DC power output from the AC/DC converter and then supplies the resultant DC power to the various circuits, are installed in the printing unit.

In an inverter circuit portion including a switching element such as a field effect transistor (FET) in the inverter of the motor driving portion, a noise is generated when the switching element is switched on/off at a high speed. In a case in which the noise is propagated to the power transmission cable, there is a concern that the noise may be propagated to the various circuits in the printing unit to which the power is supplied through the power transmission cable.

SUMMARY

An advantage of some embodiments of the invention is to provide a printing apparatus that can suppress an influence of noise generated in a mounting portion in which an inverter is provided on a printing unit or apparatus.

Hereinafter, embodiments of the invention and operation effects thereof will be described.

According to an embodiment of the invention, a printing apparatus is disclosed. The printing apparatus includes a mounting portion on which a medium is mounted, a printing unit which performs printing on the medium mounted on the mounting portion, and an electric motor that is installed in the mounting portion and that is driven when at least one of the mounting portion and the printing unit is relatively moved with respect to the other, The printing apparatus also includes an inverter that is installed in the mounting portion and that drives the electric motor based on power supplied from an AC power supply. The printing apparatus may also include a power supply portion which is installed in the mounting portion. The power supply portion supplies the power supplied from the AC power supply to the printing unit through a power transmission cable. The power supply portion includes an AC/DC converter that converts the AC power to DC power and outputs the converted power to the power transmission cable.

In one embodiment, the AC power supplied from the AC power supply to the power supply portion is converted to DC power by the AC/DC converter included in the power supply portion. The DC power is then supplied to the printing unit through the power transmission cable. For this reason, embodiments of the invention can suppress noise generated by the inverter from being propagated to the power transmission cable that supplies the DC power from the power supply portion to the printing unit.

In embodiments of printing apparatus, the printing unit includes a DC/DC converter that is capable of changing a voltage of the DC power supplied through the power transmission cable.

In one example, it is possible to change the voltage of the DC power supplied through the power transmission cable with the DC/DC converter, even in a case in which a plurality of circuits whose driving voltages are different from each other are present in the printing unit. Thus, it is possible to supply the DC power with a voltage adjusted for the respective circuits. In other words, the voltage of the DC power supplied to each of the respective circuits can be adjusted for the specific circuits.

In one embodiment of the printing apparatus, the printing unit includes a control circuit that outputs a control signal for controlling the inverter. The control circuit and the inverter are connected to each other through a communication cable that transmits the control signal to the inverter.

In one embodiment, because the propagation of noise generated by the inverter to the power transmission cable is suppressed, an influence of the noise on the control circuit is suppressed.

In one embodiment of the printing apparatus, the control signal is a differential signal.

In one example, because the differential signal, which is a transmission signal with an excellent noise resistance, is used, the propagation of noise is further suppressed. With a differential signal, for example, the noise propagating from the inverter to the power supply cable is suppressed from being propagated to the control signal to be transmitted through the communication cable.

In one embodiment, the printing apparatus further includes a guide portion which bundles and guides the power transmission cable and the communication cable.

In this case, the number of the guide portion is small compared with a configuration in which a guide portion exclusive to the power transmission cable and a guide portion exclusive to the communication cable are provided. For this reason, a configuration of the printing apparatus is simplified.

In one example, the printing apparatus further includes a metal electric box, and the inverter is accommodated in the electric box.

The metal material has a characteristic of absorbing a radiation noise. In this case, since the inverter is accommodated in the metal electric box, the radiation noise generated by the inverter is absorbed by the electric box. For this reason, the leakage of radiation noise to the outside of the electric box is suppressed. As a result, the influence of radiation noise on the printing unit can be suppressed.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, an embodiment in which a printing apparatus is embodied as an ink jet-type printer will be described with reference to the drawings.

Figure 1:
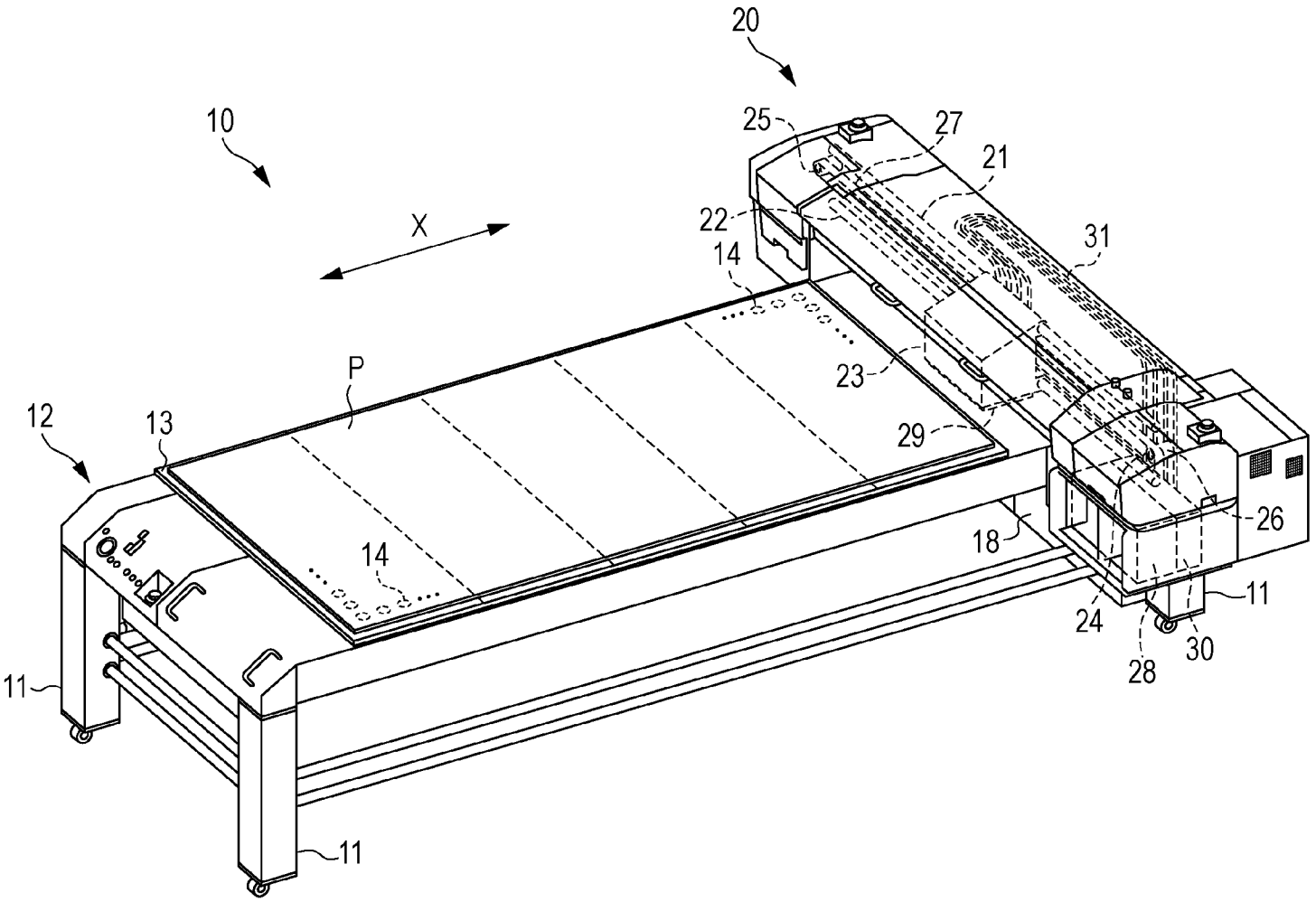
FIG. 1 is a perspective view of a printer according to an embodiment.

As illustrated in FIG. 1, a printer 10 includes a base 12. The base 12 is an example of a mounting portion which is configured to have four legs 11 placed on a floor. The top surface of the base 12 is a mounting surface 13 where a medium P such as paper is mounted. The mounting surface 13 may have a rectangle shape elongated in a direction along a length direction X of the medium P being mounted, and may have suction holes 14 that are opened on or included in the mounting surface 13. The suction holes 14 may only be provided on a partial region of the mounting surface 13 in FIG. 1 in one example. In other examples, multiple suction holes are formed throughout the entire surface of the mounting surface 13.

A guide groove (not illustrated) is formed in a lower portion of the base 12 below the mounting surface 13 along the length direction of the mounting surface 13. A liquid ejecting unit 20 including a part elongated in a direction (hereinafter, refer to as a "main scanning direction") orthogonal to a length direction of the guide groove is fitted into the guide groove. The liquid ejecting unit 20 is an example of a printing unit. The liquid ejecting unit 20 is capable of reciprocating along the length direction X (hereinafter, refer to as a "sub-scanning direction") of the medium P. When the liquid ejecting unit 20 is mounted in the guide groove, the liquid ejecting unit 20 can reciprocate in the X direction.

The liquid ejecting unit 20 includes a main shaft 21 and a sub shaft 22 extending along the main scanning direction. The main scanning direction is a longitudinal direction of the liquid ejecting unit. In addition, a carriage 23 is supported by the shafts 21 and 22 so as to be slidable along the longitudinal direction of the shafts.

In positions corresponding to both end portions of the shafts 21 and 22 in the liquid ejecting unit 20, a driving pulley 24 and a driven pulley 25 are supported so as to be rotatable. An output shaft of a carriage motor 26 is coupled to the driving pulley 24. The carriage motor 26 is a driving source to reciprocate the carriage 23. An endless timing belt 27 coupled to the carriage 23 in part is suspended by the driving pulley 24 and the driven pulley 25. According to the above-described configuration, the carriage 23 is guided by both the shafts 21 and 22, and is moved along the longitudinal direction (or the main scanning direction) of both shafts 21 and 22, by the driving force of the carriage motor 26 through the timing belt 27.

The liquid ejecting unit 20 includes, in one example, four ink cartridges 28 that accommodate different types of inks (for example, different in terms of color and/or concentration). For example, the ink cartridges 28 may accommodate individual color inks of yellow, magenta, cyan, and black. In addition, the liquid ejecting unit 20 includes a supply pump 30 that supplies ink contained in the ink cartridges 28 to a print head 29 installed in the carriage 23 through four supply passages 31.

Figure 2:
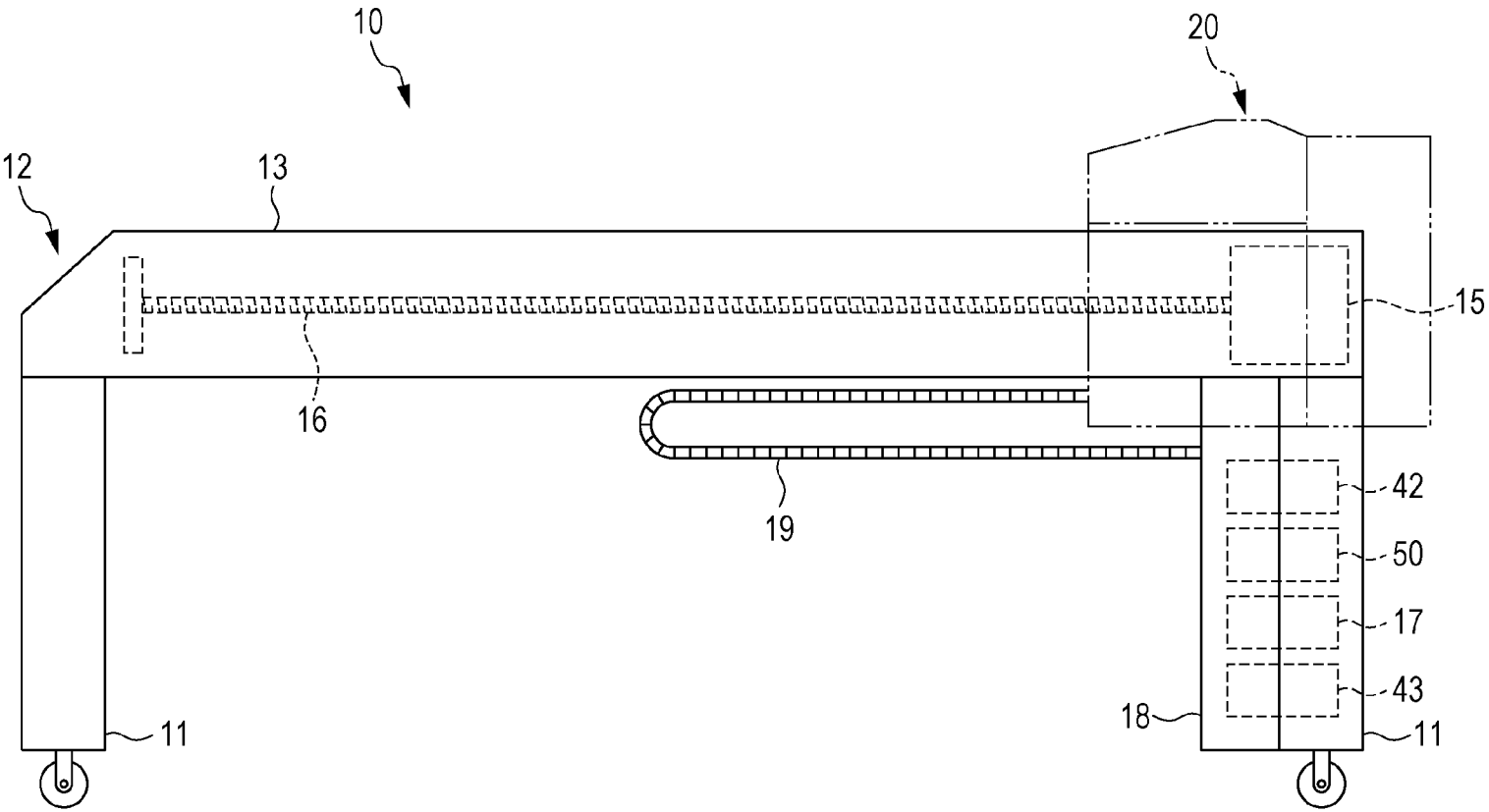
FIG. 2 is a side view of the printer according to the embodiment.

As illustrated in FIG. 2, an AC servo motor 15 (which is an example of an electric motor) is a driving source for moving the liquid ejecting unit 20 along the sub-scanning direction (the X direction). The servo motor 15 is disposed on a lower portion of the base 12 below the mounting surface 13. A ball screw 16 is coupled to the output shaft of the AC servo motor 15. The ball screw 16 thus rotates around an axial line in the sub-scanning direction in conjunction with a rotation of an output shaft of the AC servo motor 15. A nut (not illustrated) fixed to the lower portion of the liquid ejecting unit 20 is screwed with the ball screw 16. According to the above-described configuration, when the nut is moved in the sub-scanning direction by the rotation of the output shaft of the AC servo motor 15, the liquid ejecting unit 20 is moved in the sub-scanning direction over the mounting surface 13.

A suction fan 17, an electric box 18, and a guide portion 19 are provided on the lower portion of the base 12. The suction fan 17 is driven to adsorb or suction the medium P (refer to FIG. 1) to the mounting surface 13 through the suction holes 14 (refer to FIG. 1). The electric box 18 is formed of metal material, such as a steel plate, in a box shape. The electric box 18 accommodates a control device for the suction fan 17 and the base 12.

The guide portion 19 connects the electric box 18 and the liquid ejecting unit 20 to each other. The guide portion 19 is formed in a hollow shape or is hollow, and is bendable in accordance with the movement of the liquid ejecting unit 20. The guide portion 19 accommodates a power transmission cable 44 (refer to FIG. 3) that transmits power from the electric box 18 to the liquid ejecting unit 20 and a communication cable 45 (refer to FIG. 3) that transmits a signal from the liquid ejecting unit 20 to the electric box 18. The guide portion 19 accommodates the power transmission cable 44 and the communication cable 45 in a bundled state.

Next, an example configuration of a circuit of or included in the printer 10 will be described with reference to FIG. 3.

As the control device of the base 12, a servo control device 42, a fan control device 43, and a power supply portion 50 are accommodated in the electric box 18 of the base 12. One end side of a supply cable 41 and one end side of a power transmission cable 44 are inserted into the electric box 18. The DC/DC converters 46, 47, and 48 and a control circuit 49 are accommodated in the liquid ejecting unit 20.

The supply cable 41 electrically connects an AC power supply AC as a commercial power supply installed outside of the electric box 18 with the servo control device 42, the fan control device 43, and the power supply portion 50 in the electric box 18. The supply cable 41 respectively supplies the AC power of a power-supply frequency supplied from the AC power supply AC to the servo control device 42, the fan control device 43, and the power supply portion 50. The power-supply frequency may be 50 Hz or 60 Hz, by way of example.

The servo control device 42 includes an inverter 42A. The inverter 42A includes an AC/DC converter circuit portion that converts the AC power from the AC power supply AC to a DC power. An inverter circuit portion that converts DC power to an AC power of a first frequency, which is a frequency that is higher than the power-supply frequency in one example. The inverter 42A controls a rotation position and a rotation speed of the AC servo motor 15 with a feedback control in response to a signal of an encoder (not illustrated) that detects a rotation position of the AC servo motor 15.

The fan control device 43 includes an inverter 43A. The inverter 43A includes an AC/DC converter circuit portion that converts the AC power from the AC power supply AC to a DC power. An inverter circuit portion converts the DC power to an AC power of a second frequency, which is a frequency that is higher than the power-supply frequency in one example. The inverter 43A controls a driving of the suction fan 17.

The other end side of the power transmission cable 44 is inserted into the liquid ejecting unit 20. The power transmission cable 44 electrically connects the power supply portion 50 in the base 12 or on the base 12 side with the DC/DC converters 46, 47, and 48 in the liquid ejecting unit 20 or on the liquid ejecting unit 20 side.

The power supply portion 50 includes an AC/DC converter 51 that converts the AC power from the AC power supply AC to a DC power. The AC/DC converter 51 applies a voltage Vdc1 to the power transmission cable 44. The AC/DC converter 51 includes a filtering function (not illustrated) for cutting off frequencies other than a predetermined frequency band that includes a specific frequency. The specific frequency is a frequency which is different from the first frequency and a multiple of the first frequency, and that is different from the second frequency and a multiple of the second frequency. The specific frequency is, by way of example only, 50 Hz or 60 Hz, which is the same as the power-supply frequency.

The DC/DC converter 46 steps down a voltage Vdc1 of the DC power transmitted from the AC/DC converter 51 through the power transmission cable 44 to a voltage Vdc2 that is lower than the voltage Vdc1. For example, the voltage Vdc2 may be 42 V. The DC/DC converter 47 steps down the voltage Vdc1 of the AC/DC converter 51 to a voltage Vdc3 that is lower than the voltage Vdc2. For example, the voltage Vdc3 may be 24 V. The DC/DC converter 48 steps down the voltage Vdc1 of the AC/DC converter 51 to a voltage Vdc4 that is lower than the voltage Vdc3. For example, the voltage Vdc4 may be 5 V.

The control circuit 49 is electrically connected to the DC/DC converters 46, 47, and 48. The control circuit 49 includes a head driving control portion 49A controlling the print head 29 and a pump driving control portion 49B controlling a supply pump 30. In addition, the control circuit 49 includes a servo control circuit 49C controlling the servo control device 42 and a fan control circuit 49D controlling the fan control device 43.

The head driving control portion 49A includes a head driving circuit and a head control circuit (both of which are not illustrated). The head driving circuit electrically connects the DC/DC converter 46 to a piezoelectric element (not illustrated) in the print head 29, and converts the DC power of the DC/DC converter 46 to the AC power so as to supply the AC power to the piezoelectric element. The head control circuit electrically connects the DC/DC converter 48 to the head driving circuit, and controls an operation of the head driving circuit.

The pump driving control portion 49B includes a pump driving circuit and a pump control circuit (both of which are not illustrated). The pump driving circuit electrically connects the DC/DC converter 47 to the supply pump 30, and converts the DC power of the DC/DC converter 47 to an AC power so as to supply the AC power to the supply pump 30. The pump control circuit electrically connects the DC/DC converter 48 to the pump driving circuit, and controls an operation of the pump driving circuit.

The servo control circuit 49C and the fan control circuit 49D are electrically connected to the DC/DC converter 48 and the communication cable 45. The servo control circuit 49C transmits a control signal for commanding or controlling an operation of the inverter 42A of the servo control device 42 to the inverter 42A through the communication cable 45. The fan control circuit 49D transmits a control signal for commanding or controlling an operation of the inverter 43A of the fan control device 43 to the inverter 43A through the communication cable 45. The control signals of the servo control circuit 49C and the fan control circuit 49D are transmitted by differential signals in one example. FIG. 3 also illustrates that the communication cable(s) 45 and the power transmission cable 44 are disposed inside or bundled in the guide portion 19.

Next, an operation of the printer 10 according to the above-described configuration will be described with reference to a comparative circuit configuration. In the description of the comparative circuit configuration, the same numerals are given to the configuration elements that are common with those of the printer 10, and a description thereof will be omitted.

Figure 4:
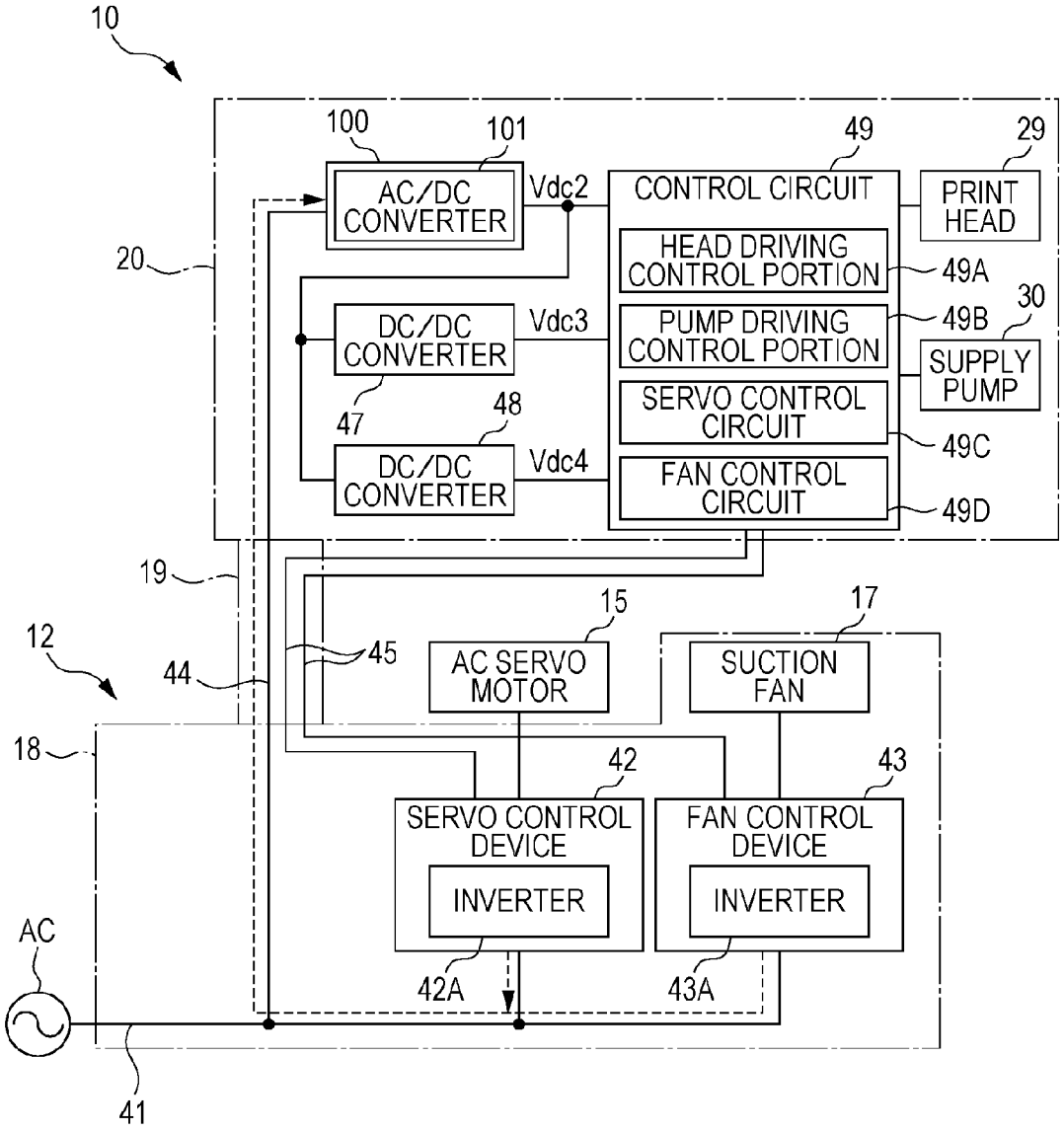
FIG. 4 is a circuit diagram of a printer according to a comparative example.

In the comparative circuit configuration, as illustrated in FIG. 4, the power supply portion 50 in the electric box 18 and the DC/DC converter 46 of the liquid ejecting unit 20 are not included. In FIG. 4, a power supply portion 100 is added to the liquid ejecting unit 20. According to the comparative circuit configuration, the power supply portion 100 includes an AC/DC converter 101 that converts the AC power supplied through the power transmission cable 44 branched from the supply cable 41 on the base 12 side to the DC power, and supplies the DC power to the DC/DC converters 47 and 48.

Figure 3:
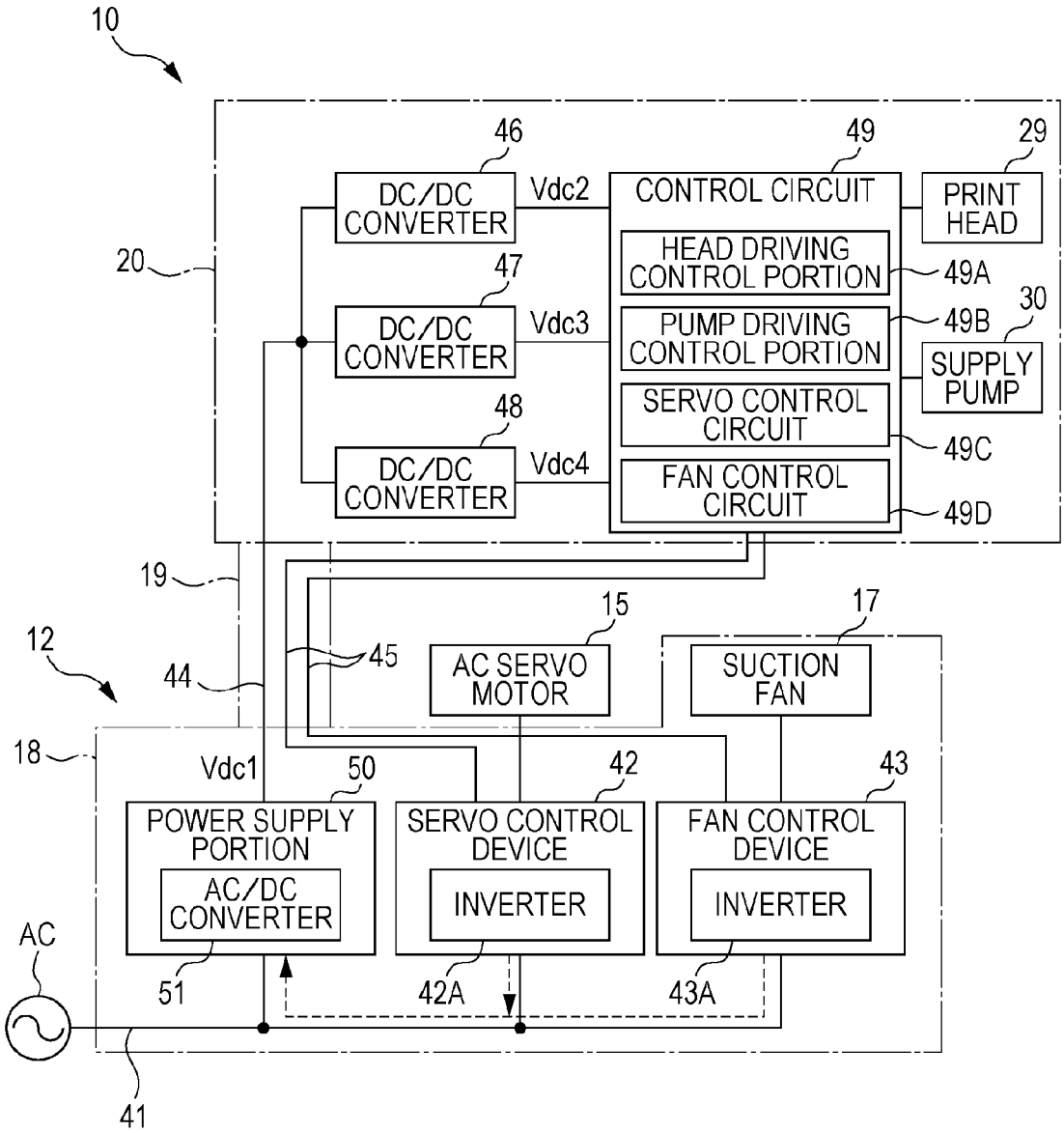
FIG. 3 is a circuit diagram of the printer according to the embodiment.

As illustrated in FIG. 3 and FIG. 4, the control device 42 of the present embodiment and the control device 42 of the comparative embodiment respectively include the inverter 42A, and the control device 43 of the present embodiment and the control device 43 of the comparative embodiment respectively include the inverter 43A. Each of the inverter 42A and the inverter 43A generates noise when a switching element (not illustrated) such as a FET is switched at a high speed. The noise is propagated to the supply cable 41 at the first frequency, at a multiple of the first frequency, at the second frequency, and at a multiple of the second frequency.

As illustrated in FIG. 4, according to the comparative circuit configuration, since the AC/DC converter 101 is disposed on the liquid ejecting unit 20 side or in the liquid ejecting unit 20, the noise generated from the inverters 42A and 43A is propagated into the liquid ejecting unit 20 through the supply cable 41 and the power transmission cable 44 as illustrated by a dashed arrow in FIG. 4. For this reason, there is a case in which the noise influences the control circuit 49. Therefore, the noise is mixed with and influences or interferes with the control signals generated from the head control circuit, the pump control circuit, the servo control circuit 49C, and the fan control circuit 49D. This is a problem because the control of the print head 29, the supply pump 30, the AC servo motor 15, and the suction fan 17 may become unstable.

Particularly, the supply cable 41 and the communication cable 45 are bundled by the guide portion 19. Thus the noise of the power transmission cable 44 easily influences the communication cable 45 as shown in FIG. 4. Therefore, the noise is easily mixed with the control signals of the servo control circuit 49C and the fan control circuit 49D in the communication cable 45. As a result, control of the AC servo motor 15 and the suction fan 17 is likely to become unstable.

Meanwhile, as illustrated in FIG. 3, in the printer 10 of one embodiment, the AC/DC converter 51 is disposed in the base 12 or on the base 12 side. The AC/DC converter 51 passes only the predetermined frequency band. The filtering function of the AC/DC converter 51 ensures that the predetermined frequency band is different from the frequency of the noise and a multiple thereof. Thus the noise of the supply cable 41 is removed by the AC/DC converter 51. For this reason, as illustrated by the dashed arrow in FIG. 3, the noise through or in the supply cable 41 is propagated to the power supply portion 50. However, propagation of the noise to the power transmission cable 44 which is on the output side of the AC/DC converter 51 is suppressed. Thus, the AC/DC converter 51 suppresses noise on the supply cable 41 from being propagated on the transmission cable 44. Accordingly, the influence of the noise on the control circuit 49 of the liquid ejecting unit 20 is decreased. Even in a case in which the power transmission cable 44 and the communication cable 45 in the guide portion 19 are in a bundled state, the influence of noise on the communication cable 45 is suppressed. Therefore, unstable control of the print head 29, the supply pump 30, the AC servo motor 15, and the suction fan 17 is suppressed. In other words, suppression of the noise can that that the print head 29, the supply pump 30, the AC servo motor 15, and the suction fan 17 can be controlled in a stable manner.

According to the above-described embodiments, the following effects can be obtained.

(1) Because the AC/DC converter 51 is disposed in the base 12 side, noise generated from the servo control device 42 and the fan control device 43 is suppressed from propagating to the power transmission cable 44 connected to the AC/DC converter 51. Accordingly, noise that would influence the control circuit 49 of the liquid ejecting unit 20, and thus the control of the devices in the liquid ejecting unit 20 such as the print head 29 and the supply pump 30 or that would cause the control to become unstable is suppressed. Accordingly, the influence of the noise generated in the base 12 side on the liquid ejecting unit 20 by can be suppressed.

Because the propagation of the noise of the inverters 42A and 43A to the control circuit 49 is suppressed by the AC/DC converter 51, the propagation of the noise to the communication cable 45 through the servo control circuit 49C and the fan control circuit 49D is suppressed. For this reason, unstable control of the AC servo motor 15 due to the control signal of the servo control circuit 49C is suppressed. In addition, unstable control of the suction fan 17 due to the control signal of the fan control circuit 49D is suppressed. Because the propagation of the noise to the communication cable 45 through the control circuit 49 is suppressed, unstable control of the inverters 42A and 43A due to the control signal from the control circuit 49 is suppressed.

(2) Because the voltage Vdc2, the voltage Vdc3, and/or the voltage Vdc4 adjusted by or output by the DC/DC converters 46, 47, and 48 are applied to the control circuit 49, it is possible to drive a plurality of circuits having different driving voltages from each other in the control circuit 49.

(3) The differential signal has an excellent noise resistance compared with a single end signal. Each of the servo control circuit 49C and the fan control circuit 49D may transmit the corresponding control signal to a servo pump and the fan control device 43 using a differential signal. For this reason, noise is not easily mixed with or into the control signal transmitted by the communication cable 45. The unstable control of the inverters 42A and 43A due to the control signal from control circuit 49 is further suppressed.

(4) Because the power transmission cable 44 and the communication cable 45 are accommodated in the guide portion 19 in a bundled state, compared with a configuration in which a guide portion is provided exclusively for the power transmission cable 44 and a separate guide portion is provided exclusively for the communication cable 45, a configuration of the printer can be simplified.

Meanwhile, in the configuration in which the guide portion 19 accommodates the power transmission cable 44 and the communication cable 45 in a bundled state, a distance between the power transmission cable 44 and the communication cable 45 is short. For this reason, in a case in which the noise is propagated to one of the power transmission cable 44 and the communication cable 45, the other cable is likely to be influenced by the noise.

However, in the printer 10 of one embodiment, because the noise of the supply cable 41 is not likely to be propagated to the power transmission cable 44 due to the AC/DC converter 51 interposed therebetween. Consequently, propagation of the noise to the communication cable 45 is suppressed. Further, since the propagation of the noise to the control circuit 49 is suppressed, the further propagation of the noise from propagated from the control circuit 49 to the communication cable 45 is suppressed. Accordingly, propagation of the noise from the communication cable 45 to the power transmission cable 44 is suppressed.

(5) Because the servo control device 42 and the fan control device 43 are accommodated in the electric box 18 which is made of steel plate, the radiation noise respectively generated from the inverter 42A of the control devices 42 and the inverter 43A of control devices 43 is suppressed from leaking to the outside of the electric box 18. For this reason, that the influence of the radiation noise on the control circuit 49 of the liquid ejecting unit 20 side is suppressed.

The above-described embodiments may be changed to other embodiments as follows.

In one embodiment, the electric box 18 may not be included. According to this configuration, the effects (1) to (4) of the above-described embodiment can be obtained.

In one embodiment, a plurality of the guide portions 19 may be included. According to this configuration, for example, one of the guide portions 19 accommodates the power transmission cable 44, and the other of the guide portions 19 accommodates the communication cable 45.

In one embodiment, the number the DC/DC converters in the liquid ejecting unit 20 may be 1, 2, 3, or 4 or more.

In one embodiment, single end signals may be used as the control signal of the servo control circuit 49C and the fan control circuit 49D. According to this configuration, the effects (1), (2), (4), and (5) of the above-described embodiment can be obtained.

In one embodiment, either or both the servo control circuit 49C and the fan control circuit 49D may be disposed in the base 12 or on the base 12 side. In this case, a DC/DC converter (not illustrated) that electrically connects either or both of the servo control circuit 49C and the fan control circuit 49D to the power supply portion 50 is provided in the base 12. The DC/DC converter steps down the voltage Vdc1 of the AC/DC converter 51 to the voltage Vdc4. In a case in which both the servo control circuit 49C and the fan control circuit 49D are disposed on the base 12 side, the communication cable 45 may not be included.

In one embodiment, the control circuit 49 may not include, one to three of: the head driving control portion 49A, the pump driving control portion 49B, the servo control circuit 49C, and the fan control circuit 49D. In short, the control circuit 49 of the above-described embodiment may include either or both of a circuit for controlling the device in the liquid ejecting unit 20 and a circuit for controlling the device in the base 12.

In the above-described embodiment, the base 12 may be moved with respect to the liquid ejecting unit 20. In addition, both the liquid ejecting unit 20 and the base 12 may be movable, and thus the liquid ejecting unit 20 and the base 12 may relatively move with respect to each other.

The printing apparatus may be a dot impact printer or a laser printer as long as printing on a medium such as paper is possible. The printing apparatus is not limited to a printer only having a printing function, but may be a multifunction machine. The printing apparatus is not limited to the serial printer, and may be a line printer or a page printer. The printing apparatus may eject liquids other than ink.

The medium is not limited to paper, and may be films made of resin, metal foils, metal films, composite films made of resin and metal (laminate film), fabrics, non-woven fabrics, and ceramic sheets.

What is claimed is:

1. A printing apparatus comprising:

a mounting portion configured to mount a medium;

a printing unit which performs printing on the medium mounted on the mounting portion, wherein the printing unit includes a control circuit that outputs a control signal for controlling the inverter, and wherein the control circuit and the inverter are connected to each other through a communication cable that transmits the control signal to the inverter;

an electric motor which is installed in the mounting portion, wherein the electric motor is driven when at least one of the mounting portion and the printing unit is relatively moved with respect to the other;

an inverter which is installed in the mounting portion, wherein the inverter drives the electric motor based on power supplied from an AC power supply; and a power supply portion which is installed in the mounting portion, wherein the power supply portion supplies the power supplied from the AC power supply to the printing unit through a power transmission cable, wherein the power supply portion includes an AC/DC converter that converts the AC power to DC power and outputs the converted DC power to the power transmission cable.

2. The printing apparatus according to claim 1, wherein the printing unit includes a DC/DC converter which is capable of changing a voltage of the DC power supplied through the power transmission cable.

3. The printing apparatus according to claim 1, wherein the control signal is a differential signal.

4. The printing apparatus according to claim 1, further comprising a guide portion which bundles and guides the power transmission cable and the communication cable between the mounting portion and the printing unit.

5. The printing apparatus according to claim 1, further comprising a metal electric box, wherein the inverter is accommodated in the electric box.

6. The printing apparatus according to claim 1, wherein the AC/DC converter suppresses noise on the supply cable from being propagated on the transmission cable.

7. The printing apparatus according to claim 1, wherein the AC/DC converter suppresses unstable control of the electric motor, a suction fan, and the inverter.

8. The printing apparatus according to claim 1, wherein the printing apparatus is one of a dot impact printer, laser printer, an inkjet printer, or a multifunction printer.

9. The printing apparatus according to claim 1, wherein one or both of the mounting portion and printing portion are movable relative to the other of the mounting portion and printing portion.

* * * * *